US007717352B2

(12) United States Patent
Löffelsend et al.

(10) Patent No.: US 7,717,352 B2
(45) Date of Patent: May 18, 2010

(54) RAIL SEAT

(75) Inventors: Herman-Josef Löffelsend, Köln (DE); Uwe Wenglorz, Köln (DE)

(73) Assignee: Kölner Verkehrs-Betriebe AG, Köln (DE)

( * ) Notice: Subject to any disclaimer, the term of this patent is extended or adjusted under 35 U.S.C. 154(b) by 108 days.

(21) Appl. No.: 11/906,375

(22) Filed: Oct. 2, 2007

(65) Prior Publication Data

US 2008/0191049 A1 Aug. 14, 2008

Related U.S. Application Data

(63) Continuation of application No. PCT/EP2006/061259, filed on Mar. 31, 2006.

(30) Foreign Application Priority Data

Apr. 2, 2005 (DE) ..... 10 2005 015 288

(51) Int. Cl.
*E01B 19/00* (2006.01)

(52) U.S. Cl. ..... 238/382; 238/283; 238/284

(58) Field of Classification Search ..... 238/283, 238/284, 285, 382, 349, 351, 264, 265, 266, 238/269, 287, 304, 306
See application file for complete search history.

(56) References Cited

U.S. PATENT DOCUMENTS 1,836,713 A * 12/1931 Hewitt ..... 238/304
1,863,145 A * 6/1932 Young ..... 238/331
2,724,558 A * 11/1955 Jones ..... 238/304
3,576,293 A * 4/1971 Landis et al. ..... 238/287
6,409,092 B1 * 6/2002 Demmig et al. ..... 238/382

FOREIGN PATENT DOCUMENTS

| | | |
|---|---|---|
| DE | 295 07 130 U1 | 7/1995 |
| DE | 195 17 112 A1 | 7/1996 |
| EP | 1 111 131 A1 | 6/2001 |
| EP | 1 118 711 A2 | 7/2001 |

* cited by examiner

*Primary Examiner*—Mark T Le
(74) *Attorney, Agent, or Firm*—Brinks Hofer Gilson & Lione

(57) ABSTRACT

A rail seat for rails having a lower patten provided on both sides with upper support surfaces, with a ribbed plate which is connected to a support by fastenings and with push-down elements for retaining the rail. The rail seat including an elastic intermediate plate arranged between the ribbed plate and the support, wherein the intermediate plate presses the ribbed plate, in a load-free condition, against an upper abutment. The ribbed plate is pressed down in a direction of the support with compression of the elastic intermediate plate. The rail seat further includes a spring element arranged between the support and the ribbed plate, wherein the spring element is connected in parallel to produce a spring action of the elastic intermediate plate.

13 Claims, 2 Drawing Sheets

RAIL SEAT

This application is a continuation of International Patent Application No. PCT/EP2006/061259, filed Mar. 31, 2006, (pending), the entire contents of which are incorporated herein by reference.

Applicants claim, under 35 U.S.C. §119, the benefit of priority of the filing date of Apr. 2, 2005 of a German patent application, copy attached, Serial Number 10 2005 015 288.0, filed on the aforementioned date, the entire contents of which is incorporated herein by reference.

BACKGROUND OF INVENTION

1. Field of the Invention

The present invention relates to rail seats for rails which have a lower patten provided on both sides with upper contact surfaces, with a fibbed plate which is connected to a support by fastenings and to push-down elements for retaining the rail.

2. Discussion of Related Art

The generic rails are in this case rails of all kinds, particularly rails or points in a railway or tramway system. However, rails in another logistic or transport system, for example in the field of warehousing or mining, may also be retained with the seating according to the invention. For this reason rail within the meaning of this application may be understood to refer to any rail of a rail-bound transport system. In this case, rails used have a lower patten provided on both sides with upper contact surfaces. The rail seat is provided with a so-called ribbed plate, which is connected to a support by fastenings and with sprung push-down elements retained on the rib plate, which elements are supported on the support surfaces for retaining the rails.

Such a rail seat is disclosed in the company brochure "Environmental protection in rail transport" from the company Clouth Gummiwerke AG. The rail seats of the prior art are used both in the region of the ballast superstructure and in the so-called "solid railroad system". In both cases vibrations due to unavoidable wheel and railroad unevenness must be compensated for in order to increase driving comfort on the one hand and minimise rolling noises on the other.

For this purpose the rail seats of the prior art have intermediate plates underneath the rail seat. These include an elastic material and absorb the load generated by the passing train. Underneath the intermediate plate is provided a support which may be formed either from an iron plate to which the remaining parts of the rail seat can be screwed, or from a concreted-in seating element. This seating element may then form part of the "solid-railroad system" or a sleeper, for example.

Furthermore an elastic intermediate layer, generally includes synthetic rubber, is arranged between the patten and the ribbed plate to prevent vibrations.

The rail seats of prior art are connected to the rails by two or more push-down elements. The rails normally have the shape of a "double-T" bracket, the upper running surface being designed thicker and the lower patten thinner, but wider for this purpose. The upper side of the laterally projecting pattens in this case serves as a support surface for the push-down elements, which in most cases are screwed on one side to the ribbed plate in the form of a wire strap, and are pushed onto the support surface with a laterally projecting region due to the force of the screw. This retains the rail. A lateral support on each side of the patten can additionally fix the rail, which is particularly appropriate at high speeds or on curves.

Although the rail seats of the prior art are able to retain the rail safely, they nevertheless have two disadvantages. Firstly, the elasticity of the intermediate layer and the intermediate plate is often insufficient, particularly in the tramway sector. Therefore it is often necessary to provide the possibility of spring deflection of the rail by up to 4 mm in tramway construction with modem crocodile cars, which possibility should also be provided in the region of the rail seats to avoid unsteady travel due to non-flexible seats.

Moreover, the assembly, and in particular the disassembly of the rail seats of prior art are very expensive. The screw connections of the push-down elements must be tightened or loosened by large square wrenches, and in this case loosening in particular may be very difficult after years of influence in most cases from thawing salt, rain or metallic rail abrasion. Because of the influence of forces associated with forceful loosening the rail seat is also often damaged so much that it has to be fully replaced. For this purpose a large area of the rail once again has to be loosened to be able to remove the entire rail seat.

OBJECTS AND SUMMARY OF THE INVENTION

An initial object of the present invention is therefore to provide an elastic rail seat which allows defined deflection of the rail with simultaneously secure fastening. A further object of the present invention is to provide a low cost rail seat that can be easily installed.

This first object is achieved according to the present invention in that the rail seat has at least one elastic intermediate plate arranged between the ribbed plate and the support, which intermediate plate pushes the ribbed plate in the load-free condition against at least one open abutment, the ribbed plate being capable of being pushed down in the direction of the support with compression of the elastic intermediate plate, and an additional spring element being arranged between the support and the ribbed plate, which element is connected in parallel to produce the spring action of the elastic intermediate plate.

A further object is achieved according to the present invention in that the ribbed plate has push-under passages with a lower pressure surface, and in that the push-down elements can be slid transversely to the longitudinal direction of the rails through the push-through openings so that they are supported resiliently on the upper support faces.

Because of the inventive design of the rail seat, an essential feature of the present invention is the fact that two different elastic elements are now connected parallel to each other. The first of these is the elastic intermediate plate which is arranged between the ribbed plate and the support. This provide a basic elasticity of the seat, but in the systems of prior art it must also absorb the total seat load. Therefore it cannot be designed so that it is elastic without limitation.

According to the present invention, not only is the elastic intermediate plate provided, but also at lest one additional spring element. This element can be arranged adjacent to the elastic intermediate plate, or may also pass through the elastic intermediate plate. The latter solution is chosen in preference because this provides a particularly compact construction of the seat which enables the spring characteristic to be achieved largely in any manner.

According to the present invention, the push-down element can now be simply be pushed through the push-through opening, either in combination with the solution of the first object or independently of it. On the rail side its end in this case runs onto the contact surface, which is normally inclined relative to the direction of insertion of the push-down element, slightly rising, for example. Consequently push-down element is slightly bent, thereby enabling it to be clamped in the push-under passage. The frictional force prevents the push-down element from sliding back.

The push-under passages of through openings are preferably formed in a part of the ribbed plate, one being used in most cases in the essentially flat ribbed plate. In the future this may possibly change, however, so that the present invention is not limited to this. The clearance remaining between the bridge and the ribbed plate then forms the through opening.

As an alternative to the above-mentioned design, a casting mould or a more complex welded structure may also be used for the ribbed plate, which may for example have a U-shaped region, the rail being inserted into the U, which is open at the top, and the through openings extending into the two legs.

The rail can be forced into the rail seat during assembly by using an elastic intermediate layer between the patten and the ribbed plate, and the intermediate layer is then clamped. A feature of this part of the present invention is therefore that the push-down element is inserted under the push-under passage with the creation of an elastic pretension, and is supported on the support surface.

Further features and advantages of the present invention are described in the dependent claims and from the following description of preferred exemplary embodiments with reference to the drawings.

DETAILED DESCRIPTION OF THE PREFERRED EMBODIMENTS

Figure 1:
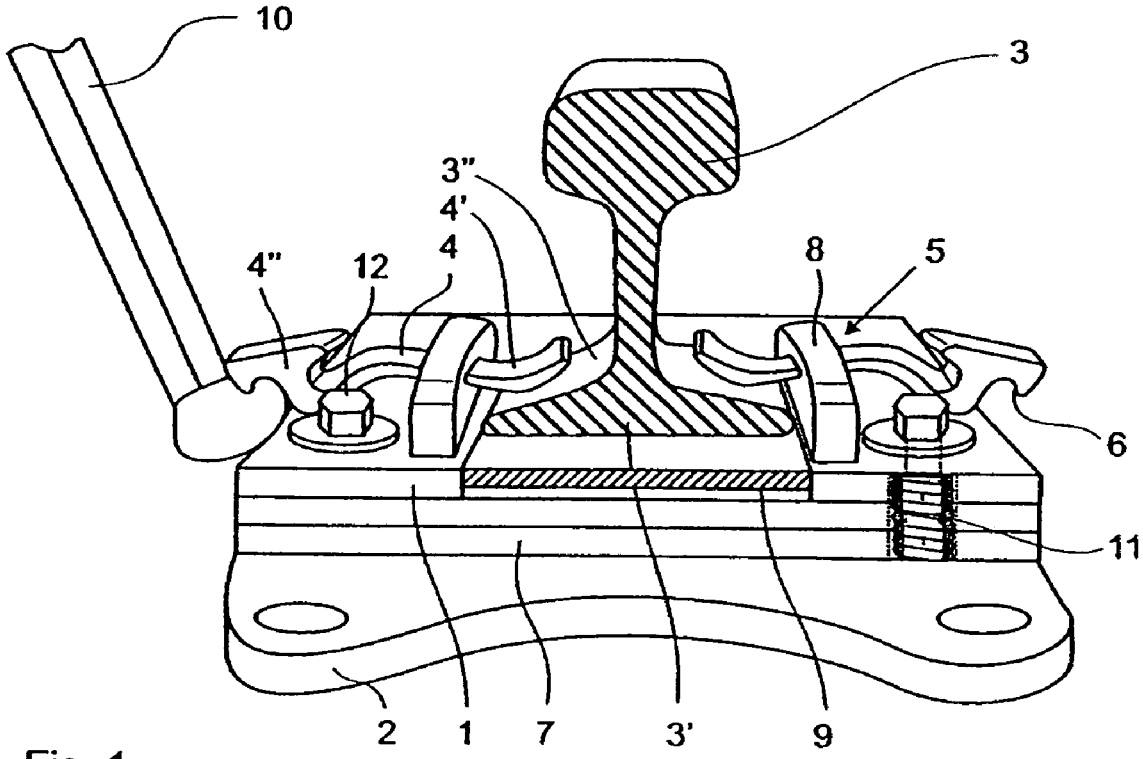
FIG. 1 shows an embodiment of a rail seat according to the present invention in a perspective view.
Figure 2:
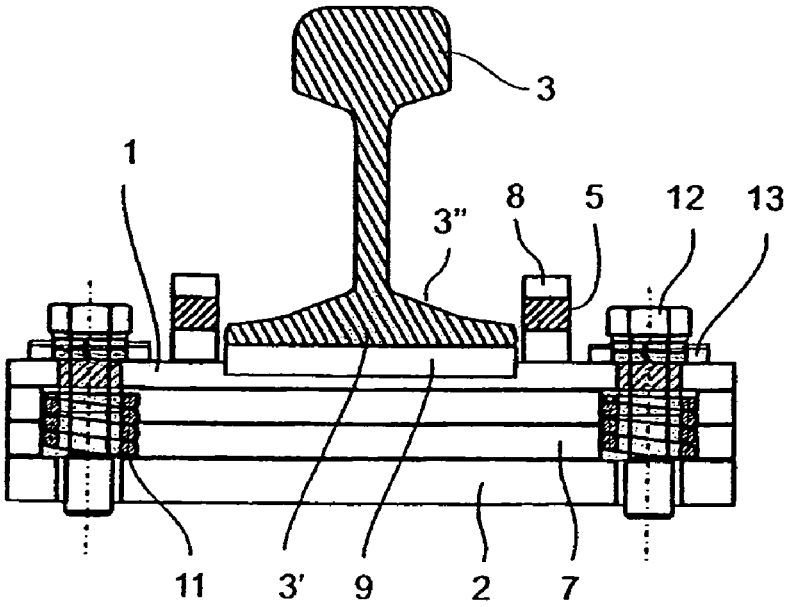
FIG. 2 shows the rail seat from FIG. 1 in a side view, partially in section.

FIGS. 1 and 2 (in FIG. 2 without a representation of the push-down elements 4) show a rail seat with a ribbed plate 1 and a support 2. The seat serves to retain and mount a rail 3, such as a railroad rail, which has a patten 3' and, on both sides, an upper contact surface 3", which is here formed by the upper side of patten 3'.

Ribbed plate 1 is provided on both sides of patten 3' with a bearing journal type attachment 8, which is here designed as a welded-on bridge. Obviously the geometry may also be produced in other ways so that a push-under passage 5 is provided which is capable of retaining an inserted push-down element 4 in the downward direction.

Push-down element 4 is inserted in a rectangular recess of the journal bearing type attachments 8, and is supported on the patten with a bending stress with a front torsional spring section 4' close to the rail. The opposite side of push-down element 4 is designed as a pressure region 4", which is supported on ribbed plate 1 as an abutment.

An intermediate layer 9 is arranged between rail 3 and ribbed plate 1. This absorbs a proportion of the bending loads as a train passes, and facilitates the elastic insertion of push-down elements 4. Underneath ribbed plate 1 is provided an elastic intermediate plate 7, which here has a multi-layer design with two layers of a rubber material arranged one above the other.

Ribbed plate 1, which extends from the right to the left edge of the rail seat, is connected by screws to support 2, here designed as a screw-on plate. The screws pass through intermediate plate 7, and to optimise the elastic properties of intermediate plate 7 the rubber used is chosen softer than usual, helical springs 11 guided by the threaded bolts of screw connection 12 being arranged between ribbed plate 1 and support 2. Both these spring systems, connected in parallel, then provide the total spring constant of the connection between ribbed plate 1 and support 2. A spring deflection of 4 mm, for example, is achieved in this manner.

For removing the rail seat push-down elements have 4 attaching edges 6 on which a pull-off tool 10 can be attached in the form of a special lever for withdrawing push-down element 4 laterally from push-under passage 5.

Ribbed plate 1 is connected here, as is generally the case, to support 2 by four screw connections 12, each of which are arranged on the corners of the rectangular ribbed plates 1. In this case the heads of the screws form the abutment for the movement of ribbed plate 1 relative to support 2, i.e. rubbed plate 2 can be moved between the lower side of the screw heads and the surface of the elastic intermediate plate 7 under the maximum possible compression. Obviously other distance limitations can also be applied.

Cup springs or laminated cup springs, or even elastic spring blocks, can now be used as additional spring elements 11. The latter may have a solid block or may be provided with openings, designed either as chambers open or closed on one side. Here the spring block may be produced from a rubber or synthetic rubber, and may have metal reinforcements or guides. Such a spring element 11 may then be provided at any point and in any number, the elastic intermediate plate 7 having recesses in which the spring blocks are then inserted.

However, the embodiment shown here has additional spring elements 11 in the form of a helical spring. These are obtainable at low cost and represent a sensible combination with the rubber layers, which in most cases form elastic intermediate layer 7. All or only some of the helical springs may be arranged concentrically to the screws of screw connection 12, i.e. they are wound round the screws and are therefore guided protected from buckling, without additional safety devices having to be provided for this purpose.

Figure 3:
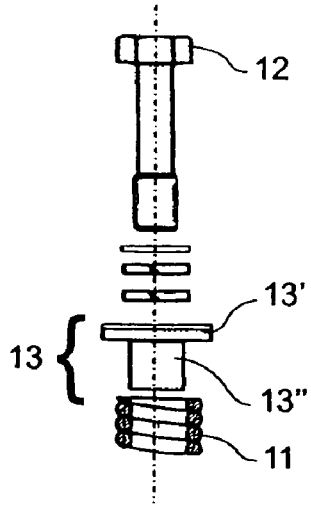
FIG. 3 shows an embodiment of a screw connection to be used with the seat shown in FIGS. 1 and 2 in an exploded representation in accordance with the present invention.

As best shown in FIG. 3, the thread of screw connection 12 can be protected by a sleeve 13 passing through elastic intermediate layer 7, which sleeve is obviously only so long that it does not restrict the required mobility. This sleeve 13 may, for example, have an upper collar 13' extending outwards in the manner of a flange and resting on the upper side of ribbed plate 1. Sleeve then projects through ribbed plate 1 into elastic intermediate layer 7 with a lower tubular section 13" connecting to this collar 13' at the bottom. The uppermost turn of the helical spring is here supported on the lower side of ribbed plate 1, ribbed plate 1 between it and the upper flange-type collar 13'.

Figure 4:
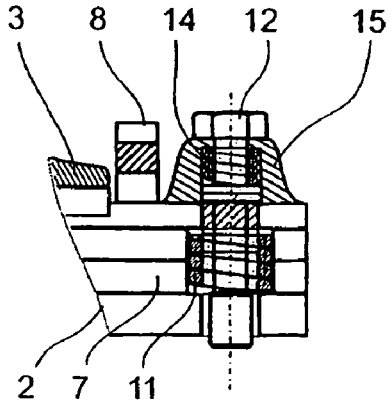
FIG. 4 shows an embodiment of an upper part of a screw connection to be used with the seat shown in FIGS. 1 and 2 in accordance with the present invention.

A further compression spring 14, in particular a helical spring wound round the screw, can be arranged between the upper abutment, i.e. the screw head and ribbed plate 1, as shown, for example, in FIG. 4.

In principle, the screw head may rise from ribbed plate 1 due to the inward compression of elastic intermediate layer 7 as a result of a train, particularly when the train brakes and due to the accompanying shift in the center of gravity, thus creating a gap adjacent to the screw into which dirt or water could possibly penetrate. A rail vehicle may automatically spread sand to increase friction, particularly in the case of emergency braking. At that particular point, however, the sand may penetrate the gap, thereby continuously filling the space inside elastic intermediate layer 7, as a result of which the spring action could then be limited initially, then even eliminated.

To avoid this a maintenance and flushing facility could of course be provided. However, this incurs a considerable cost, so the penetration of foreign bodies is preferably avoided from the beginning. For this purpose the rail seat, as shown by way of example in FIG. 4, may have a further layer in the region of screw connection 12, in particular a rubber layer for deflecting liquids, foreign bodies and/or braking sand, which layer, when viewed from the abutment, has a convex surface (15) so that particles and liquids are able to slide off and can therefore be guided away from the bore. The further elastic layer can be glued with the ribbed plate in a sealing manner to the lower side. This deflecting body for foreign substances can also of course be produced from a non-elastic material, in which case a rubber plate can be used as an intermediate disc for sealing.

Figure 5:
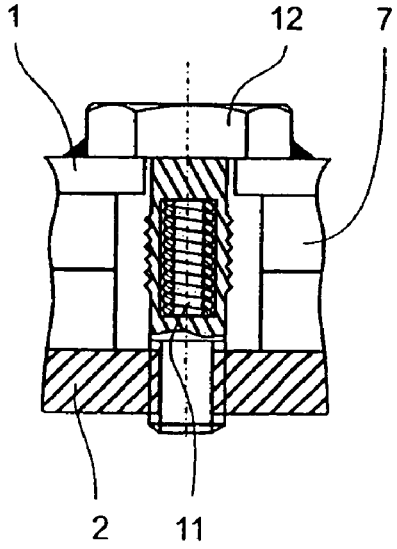
FIG. 5 shows a second embodiment of an upper part of a screw connection to be used with the seat shown in FIGS. 1 and 2 in accordance with the present invention.

A further possibility of protecting against contamination is shown in FIG. 5. Here the screw connection 12 is formed by a sleeve-like envelope 16 in which spring 11 is arranged so that a closed spring system is provided which cannot be penetrated by dirt. In order to prevent the spring action from being cancelled by the wall of sleeve-like envelope 16, this wall is formed in the central region in the manner of a concertina. This is only intended to be considered an example. Other methods of length compensation may of course be used, and even sliding over each other in the manner of a piston would be possible.

Sleeve-like envelope 16 has at the lower end a male thread with which it is screwed into support 2. At the opposite end is arranged a normal screw head which is here welded to the ribbed plate. Because of the length compensation in the central range—represented here only in a stylised manner, sleeve-like envelope 16 is able to maintain the mobility despite the connection to ribbed plate 1 and simultaneously lower support 2.

In all the designs self-locking shank end screws can be used to prevent the screws from loosening. In addition to the spring elements in the region of screw connection (12), further spring elements may also be provided which may, for example, be arranged at a greater distance from screw connection (12). Because of the distance and covering by ribbed plate 1, they would then be largely protected from contamination.

In the design of the present invention shown in FIG. 1, an under-push passage 5 is provided by which a push-down element 4 can be forced onto patten 3' of rail 3. Under-push passage 5 is here a through opening, i.e. an opening in a vertical wall of ribbed plate 1, which may be part of the plate itself, or as shown here, part of a bearing journal like attachment 8 arranged on ribbed plate 1.

The through openings preferably have a rectangular, oval or round cross-section. In the simplest case push-down elements 4 are designed, at least in sections, as bent or straight flat irons, so that the rectangular shape of the through openings shown here can then be chosen. It can be produced extremely easily and at the same time offers the largest possible support surface of push-down elements 4.

Push-down elements 4 are arranged on both sides of rail 3, although it would also be theoretically possible for rail 3 to be retained unilaterally under a retaining edge arranged on ribbed plate 1, under which edge rail 3 is then pushed at the time of displacement. Locking would then have to take place unilaterally by push-down elements 4. In this case the retaining edge should be able to transmit a mechanical stress to patten 3', which would, for example, be possible by shaping the profile so that it tapers in the direction of a rear stop so that patten 3' is pressed downwards when pushed under the retaining edge.

If push-down elements 4 are provided on one side a plurality of push-down elements 4, or even only one push-down element 4, may be arranged there. However, so that push-down elements 4 do not mutually relax and therefore eliminate the retaining tension in one of push-down elements 4, only one push-down element 4 is preferably provided on each side.

Push-down element 4 may, for example, have on the side facing away from rail 3 a pressure region 4" supported indirectly or directly on ribbed plate 1, which region produces the required tensioning of push-down element 4 and may at the same time represent a shoulder for a hammer. Pressure region 4" may also have an attaching edge 5 for attaching a pull-off tool 10, thus enabling the lever action to be applied.

The restraining force of push-down elements 4 for preventing unintentional sliding out and vandalism can be produced by the clamping force and the associated friction. Alternatively or additionally, a safety device may also be provided which may be formed either by a stop facility or a positive safety device, for example a split pin or screw.

The rail seat may be designed as a freely mountable seat, in which case the support may be formed by a support plate that can be connected to a cross sleeper. This seat is then mounted on a sleeper or even on a fixed base. Alternatively, the support may also be already let into the concrete, is will often be the case in a "solid railroad system".

The foregoing description is provided to illustrate the invention, and is not to be construed as a limitation. Numerous additions, substitutions and other changes can be made to the invention without departing from its scope as set forth in the appended claims.

LIST OF REFERENCE SYMBOLS

1 Ribbed plate
2 Support
3 Rail
3' Patten
3" Upper support surface of the rail
4 Push-down element
4' Torsional spring section of the push-down element
4" Pressure region of the push-down element
5 Push-under passage
6 Attaching edge
7 Intermediate plate
8 Bearing journal like attachments of the patten
9 Intermediate layer
10 Pull-off tool
11 Additional spring element
12 Screw connection
13 Sleeve
13' Flange-like collar of the sleeve
13" Lower tubular section of the sleeve
14 Further compression springs
15 Convex surface for particle removal
16 Sleeve-like envelope of the screw

We claim:

1. A rail seat for a rail comprising a lower patten provided on both sides with upper support surfaces, with a ribbed plate which is connected to a support by fastenings and with push-down elements for retaining said rail, wherein said ribbed plate is connected to said support by at least two screw connections, which are formed by screws screwed into said ribbed plate, wherein heads of said screws form an upper abutment, the rail seat comprising:

an elastic intermediate plate arranged between said ribbed plate and said support, wherein said intermediate plate presses said ribbed plate against said upper abutment, wherein said ribbed plate is pressed down in a direction of said support with compression of said elastic intermediate plate; and a spring element comprising a helical spring, wherein said spring element is arranged between said support and said ribbed plate, wherein said spring element is connected in parallel to produce a spring action of said elastic intermediate plate, and wherein said helical spring is arranged concentrically to said screws of said screw connection.

2. The rail seat according to claim 1, wherein said spring element passes through said elastic intermediate plate.

3. The rail seat according to claim 1, wherein said screw connection is formed from a sleeve passing through said elastic intermediate layer and one of said screws guided through said sleeve, wherein said sleeve is inserted into said helical spring with a lower tubular section and has an upper collar which is supported on an uppermost turn of said helical spring.

4. The rail seat according to claim 1, wherein a compression spring is arranged between said upper abutment and said ribbed plate.

5. The rail seat according to claim 4, wherein said compression spring comprises a helical spring wound around one of said screws.

6. The rail seat according to claim 1, further comprising a layer for deflecting liquids, foreign bodies and/or braking sand with a surface that is convex viewed from said abutment, wherein said surface is arranged around one of said screw connections so that its surface drops in a radial direction.

7. The rail seat according to claim 6, wherein said layer is elastic.

8. The rail seat according to claim 1, wherein one of said screw connections is arranged at least partially inside an envelope.

9. The rail seat according to claim 8, wherein one of said screws is formed from said envelope, wherein said sleeve-like envelope is a closed sleeve which is screwed to said support by a male thread and is connected to said ribbed plate, and wherein said envelope comprises a longitudinally compressible wall region between said ribbed plate and said support and said spring element is arranged in said envelope.

10. The rail seat according to claim 1, wherein said ribbed plate comprises a push-under passage with a lower pressure surface; and said rail support further comprising:

an upper support surface for retaining said rail;

a spring push-down element retained on said ribbed plate, said push-down element supported on said upper support surface and can be slid in a transverse direction that is transverse to a longitudinal direction of said rail through said push-under passage so that said push-down element is resiliently supported on said upper support surface, wherein said push-under passage is formed from through an opening in a region of said ribbed plate.

11. The rail seat according to the claim 10, wherein said ribbed plate is substantially a flat plate, wherein said region of said ribbed plate is formed from bearing attachments and said opening has a cross-sectional shape that is rectangular.

12. The rail seat according to claim 11, wherein said fibbed plate comprises lateral supports for supporting a patten of said rail in said transverse direction, wherein said lateral supports are formed from said bearing attachments.

13. The rail seat according to claim 10, wherein said push-down element is formed by a spring profile section which has on a rail side a spring section with an essentially rectangular cross-section supported on said upper support surface and on an opposite side has a pressure region supported on said fibbed plate, wherein said spring section is formed from a rectangular profile that is rectilinear or swung in said transverse direction, wherein said pressure region has an attaching edge for attaching a levering-off tool.

* * * * *

UNITED STATES PATENT AND TRADEMARK OFFICE

CERTIFICATE OF CORRECTION

PATENT NO. : 7,717,352 B2
APPLICATION NO. : 11/906375
DATED : May 18, 2010
INVENTOR(S) : Herman-Josef Löffelsend et al.

It is certified that error appears in the above-identified patent and that said Letters Patent is hereby corrected as shown below:

In the Claims

In column 8, claim 12, line 29, after "wherein said" replace "fibbed" with --ribbed--.

In column 8, claim 13, line 38, before "plate, wherein" replace "fibbed" with --ribbed--.

Signed and Sealed this

Twenty-ninth Day of June, 2010

David J. Kappos

David J. Kappos
*Director of the United States Patent and Trademark Office*